US006446762B1

(12) United States Patent
St. Pierre et al.

(10) Patent No.: US 6,446,762 B1
(45) Date of Patent: Sep. 10, 2002

(54) ELEVATOR MACHINE SUPPORT FRAME MOUNTED TO HOISTWAY WALL

(75) Inventors: Bruce St. Pierre, Bristol, CT (US); Bruce P. Swaybill, Farmington, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/464,118

(22) Filed: Dec. 16, 1999

(51) Int. Cl.[7] ..... B66B 7/00
(52) U.S. Cl. ..... 187/406; 187/408; 187/414
(58) Field of Search ..... 187/266, 900, 187/406, 408, 414

(56) References Cited

U.S. PATENT DOCUMENTS 4,664,230 A * 5/1987 Olsen ..... 187/406 X
5,014,822 A * 5/1991 Chapelain et al. ..... 187/408
5,311,970 A * 5/1994 Basta ..... 187/408 X
5,361,874 A * 11/1994 Brown ..... 187/406 X
6,035,974 A * 3/2000 Richter et al. ..... 187/406 X
6,193,017 B1 * 2/2001 Koster ..... 187/266 X
6,230,844 B1 * 5/2001 Latorre ..... 187/254

FOREIGN PATENT DOCUMENTS

EP 686594 A2 * 12/1995
JP 7-237862 A * 9/1995
WO WO-98/06655 A1 * 2/1998

* cited by examiner

*Primary Examiner*—Eileen D Lillis
*Assistant Examiner*—Thuy V. Tran

(57) ABSTRACT

An elevator machine mounting system for use in a machineroom-less elevator system includes a two-piece frame that is anchored to an elevator hoistway. The first frame piece is permanently anchored to the hoistway wall. The frame is anchored at the top of the hoistway and at the floor slab of the top landing. The first frame piece includes top counterweight rail brackets and a portion of the rail bracket for the car and counterweight at the top landing level. The first frame piece also includes a counterweight dead-end hitch and a controller/drive mounting. The second frame piece is fitted to the first frame piece after the elevator machine is mounted to the second frame piece. The second frame piece is adjustable postwise with respect to the first frame and then bolted thereto.

23 Claims, 5 Drawing Sheets

ELEVATOR MACHINE SUPPORT FRAME MOUNTED TO HOISTWAY WALL

TECHNICAL FIELD

The present invention relates to elevators and, more particularly, to elevator machine support frames for mounting an elevator machine with respect to an elevator hoistway.

BACKGROUND AND SUMMARY OF THE INVENTION

Conventional elevator systems include elevator machinerooms for housing the elevator machine and other components. Elevator machinerooms require buildings to have sufficient overhead space and specific structural features to accommodate the elevator machine and other components. As a result, such elevator systems are costly and lack versatility in installation requirements. These shortcomings and others have given rise to "machineroom-less" elevator systems.

Machineroom-less elevator systems provide various advantages including, for example, elimination of the need for overhead space and certain structural requirements to accommodate an elevator machineroom. Such systems are also versatile in that they have less specific structural requirements and, thus, they may be installed into a greater variety of buildings without as much customization as conventional elevator systems. Overall complexity and costs are reduced.

In typical prior art machineroom-less elevator systems, the vertical load of the elevator machine and other equipment, e.g., controllers, counterwieghts and elevator car, are supported by the elevator guide rails. However, this imposes unnecessary structural requirements on the guide rails, resulting in larger, more expensive guide rails to carry the added vertical load.

Structural support elements within an elevator hoistway wall, e.g., a reinforced concrete wall or beam at the top of the hoistway, or a top floor slab at a top elevator landing, may be used to support the vertical loads of a machineroom-less elevator system. However, because of manufacturing tolerances, elevator hoistway walls are never plumb and deviate substantially from vertical over their length. This poses a problem for any device utilizing these hoistway wall support elements, since in machineroom-less elevator systems, it is critical to properly install and align the elevator machine with the elevator car.

If the task of installing and aligning the elevator machine were simplified, reductions in installation time and cost would result, as well as other benefits.

OBJECTS AND SUMMARY OF THE INVENTION

It is an object of the present invention to provide an elevator machine mounting system for use in a machineroom-less elevator system in which installation, repair and adjustment procedures are simplified and in which costs are reduced.

It is a further object of the present invention to provide an elevator machine mounting system for use in a machineroom-less elevator system that minimizes building or structural interface requirements and that enhances safety.

It is yet a further object of the present invention to provide an elevator machine mounting system for use in a machineroom-less elevator system that accommodates the mounting of additional components.

These objects and others are achieved by the present invention as herein described.

The present invention elevator machine mounting system is directed to a machine mounting system for use in a machineroom-less elevator system. The present invention elevator machine mounting system includes a two-piece frame that is anchored to an elevator hoistway at four locations. The first frame piece is located vertically from the top landing and horizontally from the front of the hoistway wall.

The first frame piece is shimmed, plumbed and leveled before it is permanently anchored to the hoistway wall. The frame is anchored at the top of the hoistway and at the floor slab of the top landing. The first frame piece includes top counterweight rail brackets and a portion of the rail bracket for the car and counterweight at the top landing level. The first frame piece also includes a counterweight dead-end hitch and a controller/drive mounting.

The second frame piece is fitted to the first frame piece after the elevator machine is mounted to the second frame piece. The second frame piece is adjusted postwise with respect to the first frame and then bolted thereto.

DESCRIPTION OF THE PREFERRED EMBODIMENT

Figure 1A:
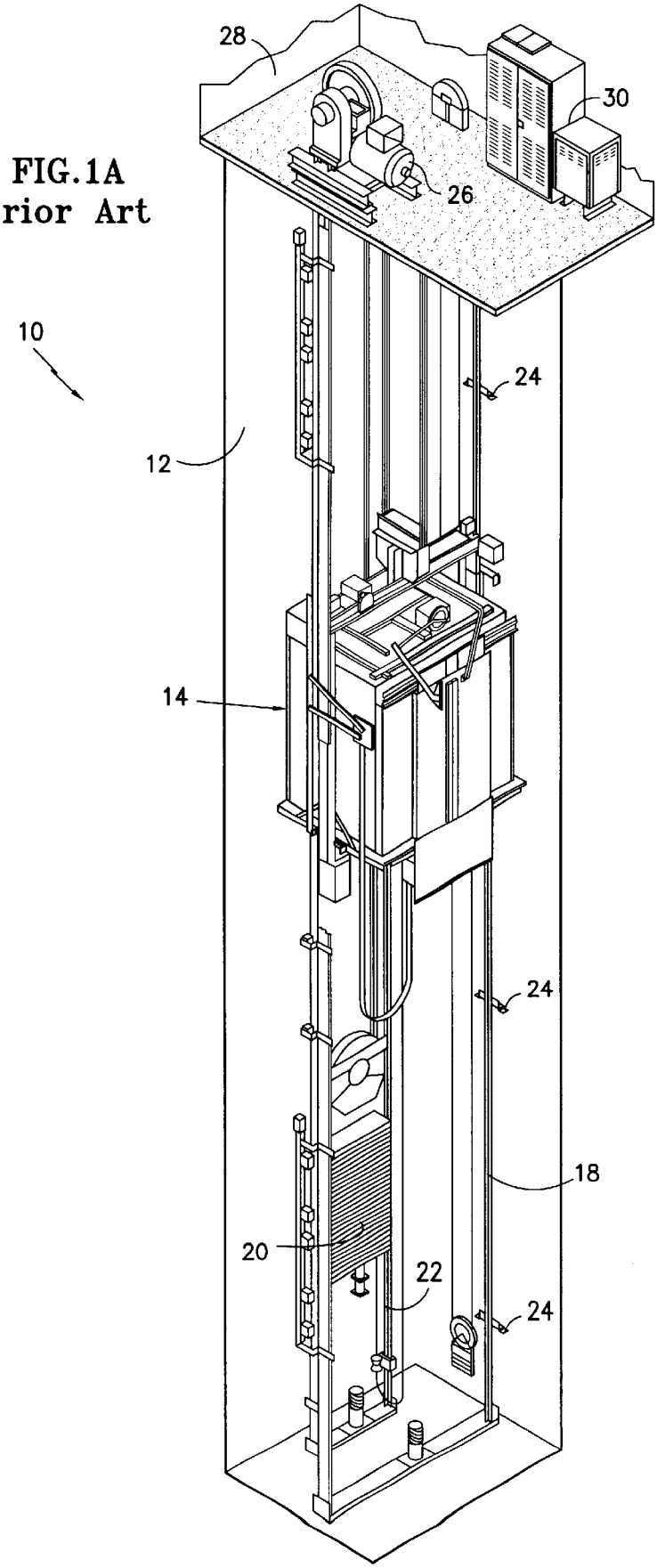
FIG.1A Prior Art
FIG. 1A is a schematic, partial illustration of a prior art elevator system.
Figure 1B:
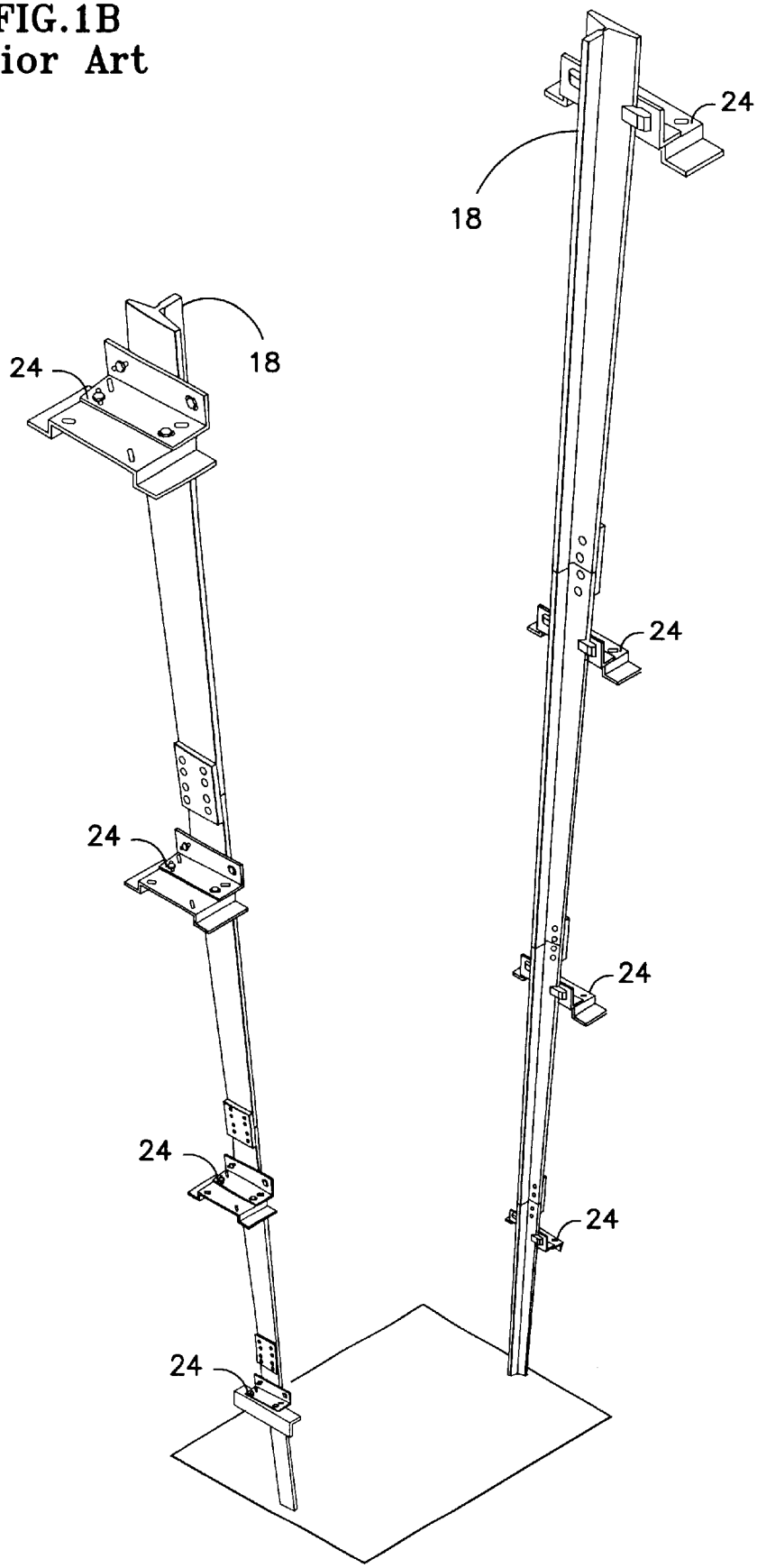
FIG.1B Prior Art
FIG. 1B is a schematic, partial illustration of guide rail components of the system illustrated in FIG. 1A.

A prior art elevator system (10) is illustrated in FIGS. 1A–1B. The elevator system (10) includes a vertical hoistway (12) in which an elevator car (14) is positioned for vertical translation therein. The elevator car (14) is adapted to translate along car guide rails (18). The counterweight (20) is adapted to translate along counterweight guide rails (22). The elevator car guide rails (18) are attached to the hoistway walls by way of brackets (24). The counterweight guide rails (22) are similarly attached to a hoistway wall by brackets (not shown). An elevator machine (26) resides in a machineroom (28) overhead of the hoistway (12). Other elevator system components such as control devices (30) reside in the machineroom (28).

Figure 2:
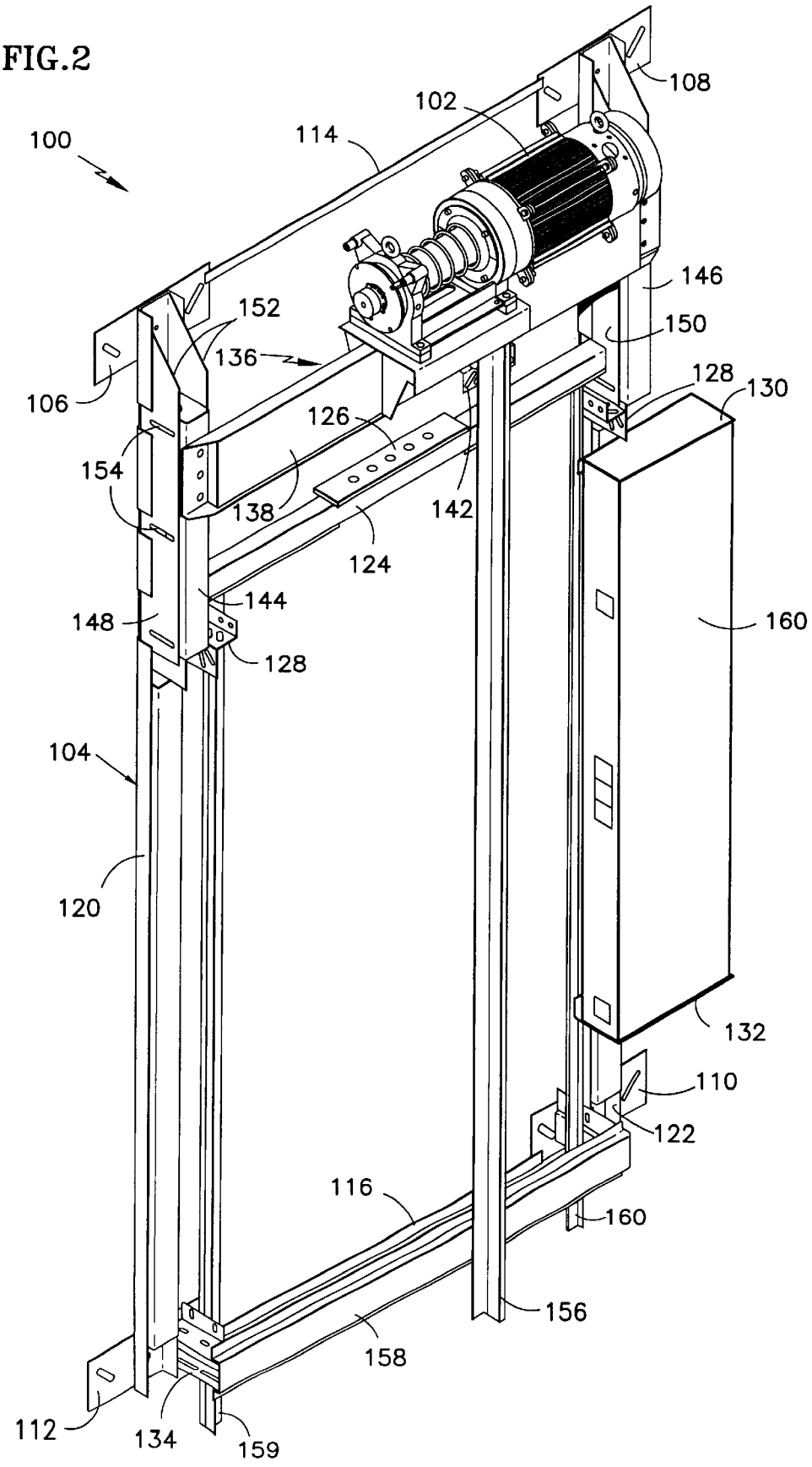
FIG. 2 is a schematic, perspective view of a preferred embodiment of the present invention mounting assembly.
Figure 3:
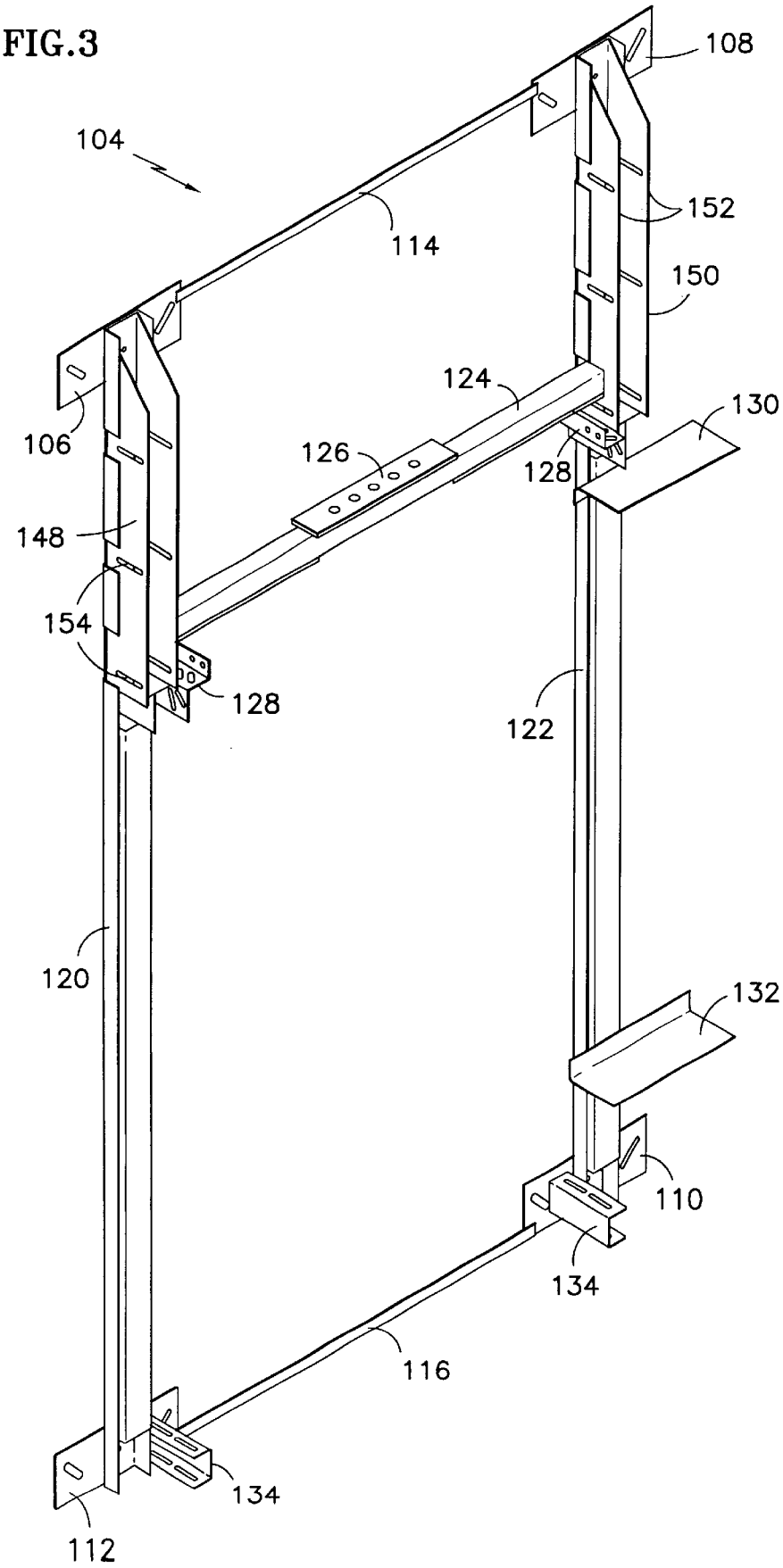
FIG. 3 is a schematic, partial perspective view of the embodiment illustrated in FIG. 2.
Figure 4:
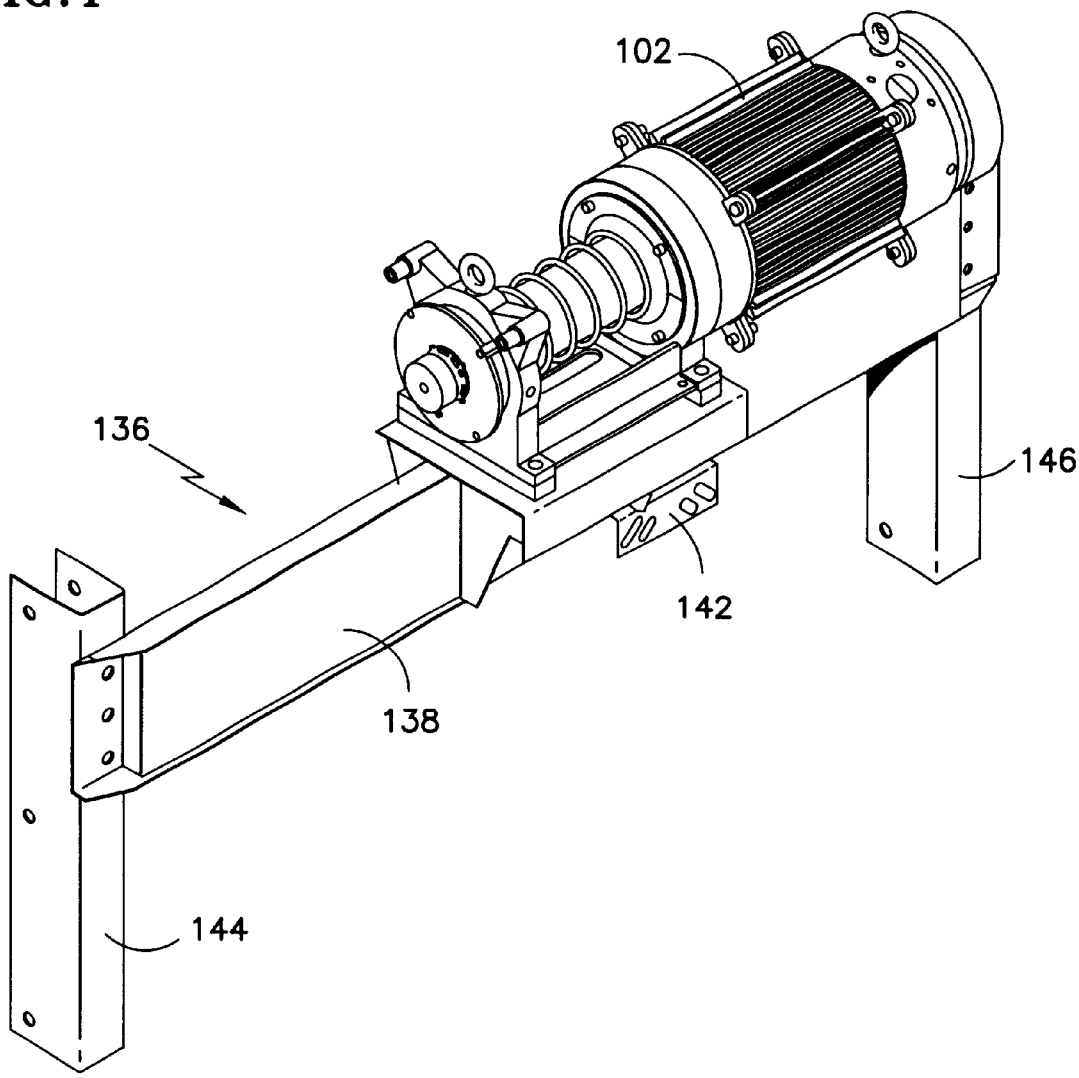
FIG. 4 is a schematic, partial perspective view of the embodiment illustrated in FIG. 2.

An exemplary embodiment of an elevator machine support frame assembly (100) according to the present invention is illustrated in FIGS. 2–4. The assembly (100) includes a first frame piece (104) that is designed to mount to the hoistway wall, and a second frame piece (136) that is designed to enable an elevator machine (102) to be fixed thereto. As will be discussed more thoroughly hereinafter, the first (104) and second (136) frame pieces are adjustable relative to each other to provide alignment of the elevator machine with an elevator car.

The first frame piece (104) is illustrated in FIG. 3. The first frame piece (104) includes four comer mounting brackets (106, 108, 110, 112). The upper brackets (106, 108) are anchored to a structural wall element, e.g., a concrete wall, concrete beam or steel beam, proximate to the top of a hoistway wall (not shown) and are laterally spaced from each other. The lower brackets (110, 112) are anchored to a structural wall element, e.g., a floor slab, at the top landing (not shown) and are laterally spaced from each other. The upper brackets (106, 108) and the lower brackets (110, 112) are each laterally connected, respectively, by rigid, horizontal structural cross-members (114, 116). The left side upper bracket (106) and lower bracket (112) are vertically connected by a first rigid, vertical structural member (120). The right side upper bracket (108) and lower bracket (110) are vertically connected by a second rigid, vertical structural member (122).

Though the first frame piece (104) is described in this exemplary embodiment as being anchored with brackets, other mounting members may also be used. By way of example, slotted portions of the structural cross members (114, 116) or vertical structural members (120, 122) may also be used.

The first frame piece (104) includes a horizontally aligned cross-support (124) and mounting bracket (126) for mounting a counterweight dead end hitch. A pair of upper counterweight rail brackets (128) are provided, one on each of the vertical structural members (120, 122). The upper counterweight rail brackets (128) facilitate attachment of vertically-aligned, parallel counterweight rails (not shown) to the first frame piece (104). A pair of lower counterweight/car rail brackets (134) are provided, one on each of the vertical structural members (120, 122). The counterweight/car rail brackets (134) facilitate attachment of vertically-aligned, parallel counterweight rails (not (shown) and provide structural support for additional hardware (discussed below) to support one elevator car guide rail (not shown) with respect to the first frame piece (104).

A pair of controller/drive mounting brackets (130, 132) are mounted to one of the vertical structural members (122). The controller/drive mounting brackets (130, 132) facilitate mounting of controller and drive components (not shown) of the elevator system to the first frame piece (104).

A second frame piece (136), as shown in FIG. 4, is provided with a horizontal rigid member (138) for mounting and supporting an elevator machine (140) thereon. An upper car rail bracket (142) is provided on the horizontal rigid member (138) for mounting the upper end of an elevator car rail (156) thereto. The horizontal rigid member (138) is attached at each end to a respective one of a pair of vertically aligned connection brackets (144, 146). The connection brackets (144, 146) are adapted to be attached to the first frame piece (104) as shown in FIG. 2 and discussed below. The horizontal rigid member (138) is preferably bolted to the connection brackets (144, 146) to facilitate convenient assembly, attachment and detachment during, for example, machine removal and re-assembly.

Referring to FIG. 2, the second frame piece (136) is attached to the first frame piece (104) by positioning the connection brackets (144, 146) of the second frame piece (136) into the connection tracks (148, 150) of the first frame piece (104). The connection tracks (148, 150) are mounted to and aligned with the vertical structural members (120, 122) at their upper ends. Each connection track (148, 150) has a pair of parallel side walls (152) so that the connection brackets (144, 146) are received within each in a slot-like manner. A set of adjustment slots (154) may be provided on each connection track (148, 150) to facilitate postwise adjustment of the second frame piece (136) relative to the first frame piece (104). That is, to facilitate adjustment of the relative distance between the elevator machine and the hoistway wall.

Though the first (104) and second (136) frame pieces are described in this embodiment as being attached with connection tracks (148, 150) and connection brackets (144, 146) respectively, other connection members may also be used, e.g., flanges. Additionally, though the first (104) and second (136) frame pieces are described as being separate and removable, they may also be permanently adjustably attached.

An elevator car rail (156) is attached to the upper car rail bracket (142) and extends vertically downward. A cross-member (158) attaches at each end to the counterweight/car rail brackets (134) and, together therewith, facilitates attachment and support of the elevator car rail (156) at the lower end of the first frame piece (104).

A pair of counterweight guide rails (158, 160) are attached at the top end, respectively, to one of the upper counterweight rail brackets (128). At the lower end of the first frame piece (104), the counterweight guide rails (158, 160) are attached, respectively, to the counterweight/car rail brackets (134). A controller/drive unit (160) is mounted to the first frame piece (104) on the controller/drive mounting brackets (130, 132).

While the preferred embodiment of the invention has been herein described, it is understood that modification and variation may be made without departing from the scope of the presently claimed invention.

What is claimed is:

1. A frame assembly for mounting to an elevator hoistway wall and supporting an elevator machine thereon, the frame assembly comprising:

a first frame piece mounted to the elevator hoistway wall, the first frame piece including an upper mounting member attached to an upper structural element of the hoistway wall, a lower mounting member attached to a lower structural element of the hoistway wall, and a first connection member; and a second frame piece including an elevator machine support member for mounting the elevator machine thereon, and a second connection member adjustably attached to the first connection member such that the relative distance between the elevator machine and the hoistway wall is adjustable.

2. The frame assembly according to claim 1 wherein the first frame piece comprises a counterweight guide rail member for mounting a counterweight guide rail thereon.

3. The frame assembly according to claim 1 wherein the first and second connection members are adjustable relative to each other to provide alignment of the elevator machine with an elevator car.

4. The frame assembly according to claim 1 comprising:

the upper mounting member attached proximate a top of the hoistway wall; and the lower mounting member attached proximate a top elevator landing of the hoistway wall.

5. The frame assembly according to claim 1 wherein:

the upper mounting member comprises a pair of upper mounting members;

the lower mounting member comprises a pair of lower mounting members;

the first connection member comprises a pair of first connection members; and the second connection member comprises a pair of second connection members.

6. The frame assembly according to claim 1 wherein the second frame piece is removably mounted to the first frame piece.

7. The frame assembly according to claim 1 wherein the upper and lower mounting members comprise upper and lower mounting brackets respectively.

8. The frame assembly according to claim 1 wherein:

the second connection member comprises a connection bracket; and the first connection member comprises a connection track for receiving the connection bracket therein, the connection track having an adjustment slot disposed thereon to provide postwise adjustment of the connection bracket relative to the connection track.

9. The frame assembly according to claim 1 wherein the first frame piece comprises a counter weight dead hitch member for mounting a counter weight dead end hitch thereon.

10. The frame assembly according to claim 1 wherein the first frame piece comprises a controller mounting member for mounting a controller component thereon.

11. The frame assembly according to claim 1 wherein the first frame piece comprises a car guide rail member for mounting a car guide rail thereon.

12. A frame assembly for mounting to an elevator hoistway wall and supporting an elevator machine thereon, the frame assembly comprising:

a first frame piece mounted to an elevator hoistway wall, the first frame piece including a pair of laterally spaced upper mounting members attached to a structural element proximate a top of the hoistway wall, a pair of laterally spaced lower mounting members attached to a structural element proximate an elevator landing of the hoistway wall, and a first pair of connection members; and a second frame piece including an elevator machine support member for mounting the elevator machine thereon, and a second pair of connection members adjustably attached to the first pair of connection members such that the relative distance between the elevator machine and the hoistway wall is adjustable.

13. The frame assembly according to claim 12 wherein the upper and lower pair of mounting members comprise upper and lower pairs of mounting brackets respectively.

14. The frame assembly according to claim 12 wherein:

the second pair of connection members comprise a pair of connection brackets; and the first pair of connection members comprise a pair of connection tracks for receiving the pair of connection brackets therein, each connection track having an adjustment slot disposed thereon to provide postwise adjustment of the connection brackets relative to the connection tracks.

15. The frame assembly according to claim 12 wherein the first and second connection members are adjustable relative to each other to provide alignment of the elevator machine with an elevator car.

16. The frame assembly according to claim 12 wherein the second frame piece is removably mounted to the first frame piece.

17. An elevator system comprising:

an elevator hoistway;

an elevator car disposed within the elevator hoistway;

an elevator machine for hoisting the elevator car, the elevator machine disposed within the elevator hoistway above the elevator car; and a frame assembly for supporting the elevator machine including, a first frame piece mounted to a hoistway wall of the elevator hoistway, the first frame piece including an upper mounting member attached to an upper structural element of the hoistway wall, a lower mounting member attached to a lower structural element of the hoistway wall, and a first connection member, and a second frame piece including an elevator machine support member for mounting the elevator machine thereon, and a second connection member adjustably attached to the first connection member such that the relative distance between the elevator machine and the hoistway wall is adjustable.

18. The elevator system according to claim 17 wherein the second frame piece is removably mounted to the first frame piece.

19. The elevator system according to claim 17 wherein the upper and lower mounting members comprise upper and lower mounting brackets respectively.

20. The elevator system according to claim 17 wherein:

the second connection member comprises a connection bracket; and the first connection member comprises a connection track for receiving the connection bracket therein, the connection track having an adjustment slot disposed thereon to provide postwise adjustment of the connection bracket relative to the connection track.

21. The elevator system according to claim 17 wherein the first and second connection members are adjustable relative to each other to provide alignment of the elevator machine with the elevator car.

22. The elevator system according to claim 17 comprising:

the upper mounting member attached proximate a top of the hoistway wall; and the lower mounting member attached proximate a top elevator landing of the hoistway wall.

23. The elevator system according to claim 17 wherein:

the upper mounting member comprises a pair of upper mounting members;

the lower mounting member comprises a pair of lower mounting members;

the first connection member comprises a pair of first connection members; and the second connection member comprises a pair of second connection members.

* * * * *